US009025775B2

(12) United States Patent
Ojala

(10) Patent No.: US 9,025,775 B2
(45) Date of Patent: May 5, 2015

(54) APPARATUS AND METHOD FOR ADJUSTING SPATIAL CUE INFORMATION OF A MULTICHANNEL AUDIO SIGNAL

(75) Inventor: Pasi Ojala, Kirkkonummi (FI)

(73) Assignee: Nokia Corporation, Espoo (FI)

( * ) Notice: Subject to any disclaimer, the term of this patent is extended or adjusted under 35 U.S.C. 154(b) by 575 days.

(21) Appl. No.: 13/002,486

(22) PCT Filed: Jul. 1, 2008

(86) PCT No.: PCT/EP2008/058455
§ 371 (c)(1),
(2), (4) Date: Jan. 3, 2011

(87) PCT Pub. No.: WO2010/000313
PCT Pub. Date: Jan. 7, 2010

(65) Prior Publication Data
US 2011/0103591 A1 May 5, 2011

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
USPC ..... 381/1, 2, 17–23, 96–97; 700/94; 367/118
See application file for complete search history.

(56) References Cited

U.S. PATENT DOCUMENTS 5,014,250 A * 5/1991 Hadderingh ..... 367/124
5,671,287 A * 9/1997 Gerzon ..... 381/17
7,116,787 B2 10/2006 Faller
7,787,638 B2 * 8/2010 Lokki et al. ..... 381/92
7,835,918 B2 * 11/2010 Myburg et al. ..... 704/501
8,135,136 B2 * 3/2012 Van Loon et al. ..... 381/1
8,290,167 B2 * 10/2012 Pulkki et al. ..... 381/23
8,295,493 B2 * 10/2012 Faller ..... 381/1
2006/0106620 A1 5/2006 Thompson et al.
2007/0160218 A1 7/2007 Jakka et al.
2010/0166191 A1 * 7/2010 Herre et al. ..... 381/1

FOREIGN PATENT DOCUMENTS

CN 101160618 A 4/2008
CN 101180674 A 5/2008
WO 2006/014449 A1 2/2006

(Continued)

OTHER PUBLICATIONS

Beack et al, Multichannel sound scene control for mpeg surround, Sep. 2006.*

(Continued)

*Primary Examiner* — Davetta W Goins
*Assistant Examiner* — Kuassi Ganmavo
(74) *Attorney, Agent, or Firm* — Alston & Bird LLP

(57) ABSTRACT

An apparatus for enhancing a multichannel audio signal comprising at least two channels configured to: estimate a value representing a direction of arrival associated with a first audio signal from at least a first channel and a second audio signal from at least a second channel of at least two channels of a multichannel audio signal; determine a scaling factor dependent on the direction of arrival associated with the first audio signal and the second audio signal; and apply the scaling factor to a parameter associated with a difference in audio signal levels between the first audio signal and the second audio sign.

22 Claims, 6 Drawing Sheets

(56) References Cited

FOREIGN PATENT DOCUMENTS

| | | | |
|---|---|---|---|
| WO | 2006/072270 | A1 | 7/2006 |
| WO | 2006/098583 | A1 | 9/2006 |
| WO | 2006/126856 | A2 | 11/2006 |
| WO | 2007/089131 | A1 | 8/2007 |

OTHER PUBLICATIONS

Lee et al, reduction of sound localization error for surround sound system using enhanced constant power panning law, 2004.*
Office Action dated Jun. 19, 2012 for corresponding Chinese Application No. 200880130197.3, 5 pages.
Office Action received in corresponding Chinese Application No. 200880130197.3, Dated Jan. 5, 2012, 8 pages.
Faller et al., "Binaural Cue Coding—Part II: Schemes and Applications", IEEE Transactions on Speech and Audio Processing, vol. 11, No. 6, Nov. 2003, pp. 520-531.
Faller, "Parametric Multichannel Audio Coding: Synthesis of Coherence Cues", IEEE Transactions on Audio, Speech, and Language Processing, vol. 14, No. 1, Jan. 2006, pp. 299-310.
International Search Report received for corresponding Patent Cooperation Treaty Application No. PCT/EP2008/058455, dated Feb. 24, 2009, 12 pages.
ISO/IEC JCI/Sc29/WG11 (MPEG), N8639, "Draft Call for proposals on Spatial Audio Object Coding", Hangzhou, China (Oct. 2006)
ISO/IEC JTCI/SC29/WG11 (MPEG), N13632, "From Channel-Oriented to Object Oriented Spatial Audio Object Coding", Klangenfurt, Austria (Oct. 2006)

* cited by examiner

APPARATUS AND METHOD FOR ADJUSTING SPATIAL CUE INFORMATION OF A MULTICHANNEL AUDIO SIGNAL

RELATED APPLICATION

This application was originally filed as PCT Application No. PCT/EP2008/058455 filed 1 Jul. 2008, which is incorporated herein by reference in its entirety.

FIELD OF THE INVENTION

The present invention relates to apparatus configured to carry out the coding of audio and speech signals

BACKGROUND OF THE INVENTION

Spatial audio processing is the effect of an audio signal emanating from an audio source arriving at the left and right ears of a listener via different propagation paths. As a consequence of this effect the signal at the left ear will typically have a different arrival time and signal level to that of the corresponding signal arriving at the right ear. The difference between the times and signal levels are functions of the differences in the paths by which the audio signal travelled in order to reach the left and right ears respectively. The listener's brain then interprets these differences to give the perception that the received audio signal is being generated by an audio source located at a particular distance and direction relative to the listener.

An auditory scene therefore maybe viewed as the net effect of simultaneously hearing audio signals generated by one or more audio sources located at various positions relative to the listener.

The mere fact that the human brain can process a binaural input signal in order to ascertain the position and direction of a sound source can be used to code and synthesis auditory scenes. A typical method of spatial auditory coding will therefore seek to model the salient features of an audio scene. This normally entails purposefully modifying audio signals from one or more different sources in order to generate left and right audio signals. In the art these signals may be collectively known as binaural signals. The resultant binaural signals may then be generated such that they give the perception of varying audio sources located at different positions relative to the listener.

Recently, spatial audio techniques have been used in connection with multi-channel audio reproduction. The objective of multichannel audio reproduction is to provide for efficient coding of multi channel audio signals comprising five of more (a plurality) of separate audio channels or sound sources. Recent approaches to the coding of multichannel audio signals have centred on the methods of parametric stereo (PS) and Binaural Cue Coding (BCC). BCC typically encodes the multi-channel audio signal by down mixing the various input audio signals into either a single ("sum") channel or a smaller number of channels conveying the "sum" signal. In parallel, the most salient inter channel cues, otherwise known as spatial cues, describing the multi-channel sound image or audio scene are extracted from the input channels and coded as side information. Both the sum signal and side information form the encoded parameter set which can then either be transmitted as part of a communication chain or stored in a store and forward type device. Most implementations of the BCC technique typically employ a low bit rate audio coding scheme to further encode the sum signal. Finally, the BCC decoder generates a multi-channel output signal from the transmitted or stored sum signal and spatial cue information. Further information regarding the BCC technique can be found in the following IEEE publication Binaural Cue Coding—Part II Schemes and Applications in IEEE Transactions on Speech and Audio Processing, Vol. 11, No 6, November 2003 by Baumgarte, F. and Faller, C. Typically down mix signals employed in spatial audio coding systems are additionally encoded using low bit rate perceptual audio coding techniques such as the ISO/IEC Moving Pictures Expert Group Advanced Audio Coding standard to further reduce the required bit rate.

In typical implementations of spatial audio multichannel coding the set of spatial cues comprise; an inter channel level difference parameter (ICLD) which models the relative difference in audio levels between two channels, and an inter channel time delay value (ICTD) which represents the time difference or phase shift of the signal between the two channels. The audio level and time differences are usually determined for each channel with respect to a reference channel. Alternatively some systems may generate the spatial audio cues with the aide of head related transfer function (HRTF). Further information on such techniques may be found in The Psychoacoustics of Human Sound Localization by J. Blaubert and published in 1983 by the MIT Press.

Although ICLD and ICTD parameters represent the most important spatial audio cues, spatial representations using these parameters may be further enhanced with the incorporation of an inter channel coherence (ICC) parameter. By incorporating such a parameter into the set of spatial audio cues allows the perceived spatial "diffuseness" or conversely the spatial "compactness" to be represented in the reconstructed signal.

For BCC one of the major issues to be solved is the representation and efficient coding of the parameters associated with the coding process. As stated before the down mix signal may be efficiently coded using conventional audio source coding techniques such as AAC, and this efficient coding doctrine may also be applied to the spatial cue parameters. However coding typically introduces errors into the spatial cue parameters and one of the challenges is to be able to increase the spatial audio experience to the listener without having to expend any further coding bandwidth than is absolutely necessary. One technique commonly used in speech and audio coding which may be applied to BCC is to enhance particular regions of the signal to be encoded in order to mask any errors introduced by the process of coding, and to improve the overall perceived audio experience.

SUMMARY OF THE INVENTION

This invention proceeds from the consideration that it is desirable to adjust the spatial cue information in order to enhance the overall spatial audio experience perceived by the listener. The problem associated with this is how to adjust the spatial cues such that the resultant enhancement is dependent on the particular characteristics of the spatial audio signal.

Embodiments of the present invention aim to address the above problem.

There is provided according to a first aspect of the invention a method comprising: estimating a value representing a direction of arrival associated with a first audio signal from at least a first channel and a second audio signal from at least a second channel of at least two channels of a multichannel audio signal; determining a scaling factor dependent on the direction of arrival associated with the first audio signal and the second audio signal; and applying the scaling factor to a parameter associated with a difference in audio signal levels between the first audio signal and the second audio signal.

According to an embodiment of the invention the method further comprises; determining a value representing the coherence of the first audio signal and the second audio signal.

The method may also further comprise; determining a reliability estimate for the value representing the direction of arrival associated with the first audio signal and the second audio signal.

Applying the scaling factor to the parameter associated with the difference in audio signal levels between the first audio signal and the second audio signal is preferably dependant on at least one of the following: the reliability estimate for the value representing the direction of arrival associated with the first audio signal and the second audio signal; and the value representing the coherence of the first audio signal and the second audio signal.

Estimating the value representing the direction of arrival associated with a first audio signal and a second audio signal may comprise: using a first model based on a direction of arrival of a virtual audio signal, wherein the virtual audio signal is associated with an audio signal derived from the combining of at least two audio signals emanating from at least two audio signal sources.

Determining the reliability estimate for the value representing the direction of arrival associated with the first audio signal and the second audio signal may comprise: estimating at least one further value representing the direction of arrival associated with the first audio signal and the second audio signal, wherein estimating the at least one further value representing the direction of arrival associated with the first audio signal and the second audio signal may further comprise using a second model based on the direction of arrival of a virtual audio signal, wherein the virtual audio signal is preferably associated with an audio signal derived from the combining of at least two audio signals emanating from at least two audio signal sources; and preferably determining whether the difference between the value representing the direction of arrival associated with the first audio signal and the second audio signal, and the at least one further value representing the direction of arrival may be associated with the first audio signal and the second audio signal lies within a predetermined error bound.

The first model based on the direction of arrival of the virtual audio signal is preferably dependent on a difference in audio signal levels between two audio signals.

The first model based on the direction of travel of the virtual audio signal may comprise a spherical model of the head.

The second model based on the direction of arrival of the virtual audio signal is preferably dependent on a difference in a time of arrival between two audio signals.

The second model based on the direction of travel of the virtual audio signal may comprise a model based on the sine wave panning law.

Determining the scaling factor dependent on the direction of arrival associated with the first audio signal and the second audio signal may comprise: assigning the scaling factor a value from a first pre determined range of values of at least one pre determined range of values, wherein the first pre determined range of values may be selected according to the value representing a direction of travel of a virtual audio signal associated with the first audio signal and the second audio signal.

Applying the scaling factor to the parameter associated with the difference in audio signal levels between the first audio signal and the second audio signal may comprise: multiplying the scaling factor with the parameter associated with the difference in audio signal levels between the first audio signal and the second audio signal.

The parameter associated with the difference in audio signal levels between the first audio signal and the second audio signal preferably is a logarithmic parameter.

The multichannel audio signal is preferably a frequency domain signal.

The multichannel audio signal is preferably partitioned into a plurality of sub bands, and the method for enhancing the multichannel audio signal is preferably applied to at least one of the plurality of sub bands.

The method is preferably for enhancing the multichannel audio signal comprising the at least two channels.

According to a second aspect of the present invention there is provided an apparatus configured to: estimate a value representing a direction of arrival associated with a first audio signal from at least a first channel and a second audio signal from at least a second channel of at least two channels of a multichannel audio signal; determine a scaling factor dependent on the direction of arrival associated with the first audio signal and the second audio signal; and apply the scaling factor to a parameter associated with a difference in audio signal levels between the first audio signal and the second audio sign.

According to an embodiment of the invention the apparatus is preferably further configured to determine a value representing the coherence of the first audio signal and the second audio signal.

The apparatus may be further configured to: determine a reliability estimate for the value representing the direction of arrival associated with the first audio signal and the second audio signal.

The apparatus configured to apply the scaling factor to the parameter associated with the difference in audio signal levels between the first audio signal and the second audio signal may depend on at least one of the following: the reliability estimate for the value representing the direction of arrival associated with the first audio signal and the second audio signal; and the value representing the coherence of the first audio signal and the second audio signal.

The apparatus configured to estimate the value representing the direction of arrival associated with a first audio signal and a second audio signal may be further configured to: use a first model based on a direction of arrival of a virtual audio signal, wherein the virtual audio signal is preferably associated with an audio signal derived from the combining of at least two audio signals emanating from at least two audio signal sources.

The apparatus configured to determine the reliability estimate for the value representing the direction of arrival associated with the first audio signal and the second audio signal may be further configured to: estimate at least one further value representing the direction of arrival associated with the first audio signal and the second audio signal, wherein estimating the at least one further value representing the direction of arrival associated with the first audio signal and the second audio signal may further comprise using a second model based on the direction of arrival of a virtual audio signal, wherein the virtual audio signal is preferably associated with an audio signal derived from the combining of at least two audio signals emanating from at least two audio signal sources; and may determine whether the difference between the value representing the direction of arrival associated with the first audio signal and the second audio signal, and the at least one further value may represent the direction of arrival associated with the first audio signal and the second audio signal may lie within a predetermined error bound.

The first model based on the direction of arrival of the virtual audio signal may be dependent on a difference in audio signal levels between two audio signals.

The first model based on the direction of travel of the virtual audio signal may comprise a spherical model of the head.

The second model based on the direction of arrival of the virtual audio signal may be dependent on a difference in a time of arrival between two audio signals.

The second model based on the direction of travel of the virtual audio signal may comprise a model based on the sine wave panning law.

The apparatus configured to determine the scaling factor dependent on the direction of arrival associated with the first audio signal and the second audio signal may be further configured to: assign the scaling factor a value from a first pre determined range of values of at least one pre determined range of values, wherein the first pre determined range of values is preferably selected according to the value representing a direction of travel of a virtual audio signal associated with the first audio signal and the second audio signal.

The apparatus configured to apply the scaling factor to the parameter associated with the difference in audio signal levels between the first audio signal and the second audio signal may be further configured to: multiply the scaling factor with the parameter associated with the difference in audio signal levels between the first audio signal and the second audio signal.

The parameter associated with the difference in audio signal levels between the first audio signal and the second audio signal is preferably a logarithmic parameter.

The multichannel audio signal is preferably a frequency domain signal.

The multichannel audio signal may be partitioned into a plurality of sub bands, and the apparatus is configured to preferably enhance at least one of the plurality of sub bands of the multichannel audio signal.

The apparatus may be for enhancing a multichannel audio signal comprising at least two channels.

An audio encoder may comprise an apparatus as described above.

An audio decoder may comprise an apparatus as described above.

An electronic device may comprise an apparatus as described above.

A chip set may comprise an apparatus as described above.

According to a third aspect of the present invention there is provided a computer program product configured to perform a method comprising: estimating a value representing a direction of arrival associated with a first audio signal from at least a first channel and a second audio signal from at least a second channel of at least two channels of a multichannel audio signal; determining a scaling factor dependent on the direction of arrival associated with the first audio signal and the second audio signal; and applying the scaling factor to a parameter associated with a difference in audio signal levels between the first audio signal and the second audio signal.

According to a fourth aspect of the invention there is provided an apparatus comprising: estimating means for estimating a value representing a direction of arrival associated with a first audio signal from at least a first channel and a second audio signal from at least a second channel of at least two channels of a multichannel audio signal; processing means for determining a scaling factor dependent on the direction of arrival associated with the first audio signal and the second audio signal; and further processing means for applying the scaling factor to a parameter associated with a difference in audio signal levels between the first audio signal and the second audio signal.

BRIEF DESCRIPTION OF DRAWINGS

For better understanding of the present invention, reference will now be made by way of example to the accompanying drawings in which.

DESCRIPTION OF PREFERRED EMBODIMENTS OF THE INVENTION

Figure 1:
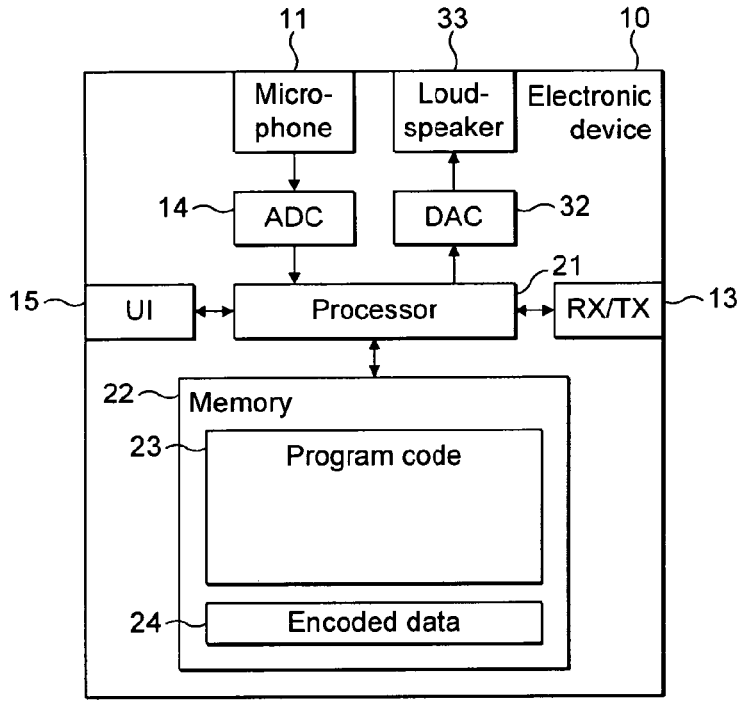
FIG. 1 shows schematically an electronic device employing embodiments of the invention.

The following describes in more detail possible mechanisms for the provision of enhancing spatial audio cues for an audio codec. In this regard reference is first made to FIG. 1 schematic block diagram of an exemplary electronic device 10, which may incorporate a codec according to an embodiment of the invention.

The electronic device 10 may for example be a mobile terminal or user equipment of a wireless communication system.

The electronic device 10 comprises a microphone 11, which is linked via an analogue-to-digital converter 14 to a processor 21. The processor 21 is further linked via a digital-to-analogue converter 32 to loudspeakers 33. The processor 21 is further linked to a transceiver (TX/RX) 13, to a user interface (UI) 15 and to a memory 22.

The processor 21 may be configured to execute various program codes. The implemented program codes comprise an audio encoding code for encoding a lower frequency band of an audio signal and a higher frequency band of an audio signal. The implemented program codes 23 further comprise an audio decoding code. The implemented program codes 23 may be stored for example in the memory 22 for retrieval by the processor 21 whenever needed. The memory 22 could further provide a section 24 for storing data, for example data that has been encoded in accordance with the invention.

The encoding and decoding code may in embodiments of the invention be implemented in hardware or firmware.

The user interface 15 enables a user to input commands to the electronic device 10, for example via a keypad, and/or to obtain information from the electronic device 10, for example via a display. The transceiver 13 enables a communication with other electronic devices, for example via a wireless communication network.

It is to be understood again that the structure of the electronic device 10 could be supplemented and varied in many ways.

A user of the electronic device 10 may use the microphone 11 for inputting speech that is to be transmitted to some other electronic device or that is to be stored in the data section 24 of the memory 22. A corresponding application has been activated to this end by the user via the user interface 15. This application, which may be run by the processor 21, causes the processor 21 to execute the encoding code stored in the memory 22.

The analogue-to-digital converter 14 converts the input analogue audio signal into a digital audio signal and provides the digital audio signal to the processor 21.

The processor 21 may then process the digital audio signal in the same way as described with reference to FIGS. 2 and 3.

The resulting bit stream is provided to the transceiver 13 for transmission to another electronic device. Alternatively, the coded data could be stored in the data section 24 of the memory 22, for instance for a later transmission or for a later presentation by the same electronic device 10.

The electronic device 10 could also receive a bit stream with correspondingly encoded data from another electronic device via its transceiver 13. In this case, the processor 21 may execute the decoding program code stored in the memory 22.

The processor 21 decodes the received data, and provides the decoded data to the digital-to-analogue converter 32. The digital-to-analogue converter 32 converts the digital decoded data into analogue audio data and outputs them via the loudspeakers 33. Execution of the decoding program code could be triggered as well by an application that has been called by the user via the user interface 15.

The received encoded data could also be stored instead of an immediate presentation via the loudspeakers 33 in the data section 24 of the memory 22, for instance for enabling a later presentation or a forwarding to still another electronic device.

Figure 2:
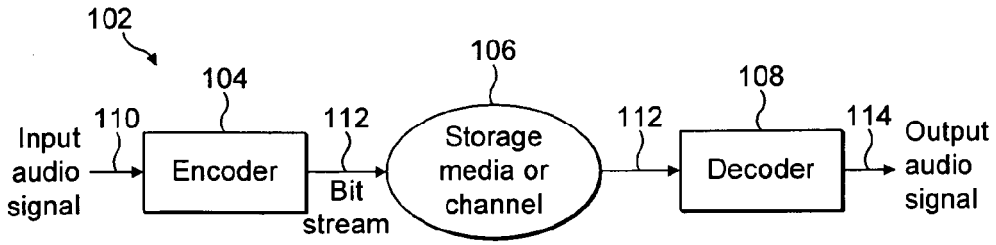
FIG. 2 shows schematically an audio codec system employing embodiments of the present invention.
Figure 3:
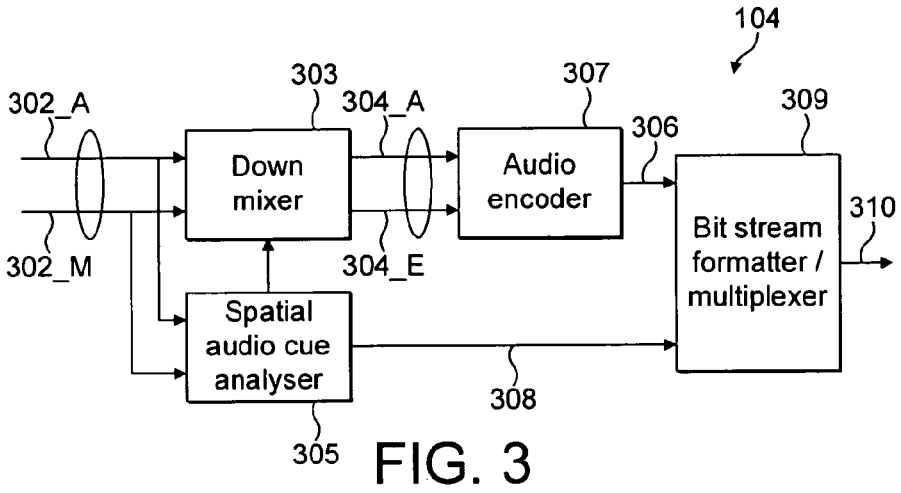
FIG. 3 shows schematically an audio encoder deploying a first embodiment of the invention.
Figure 4:
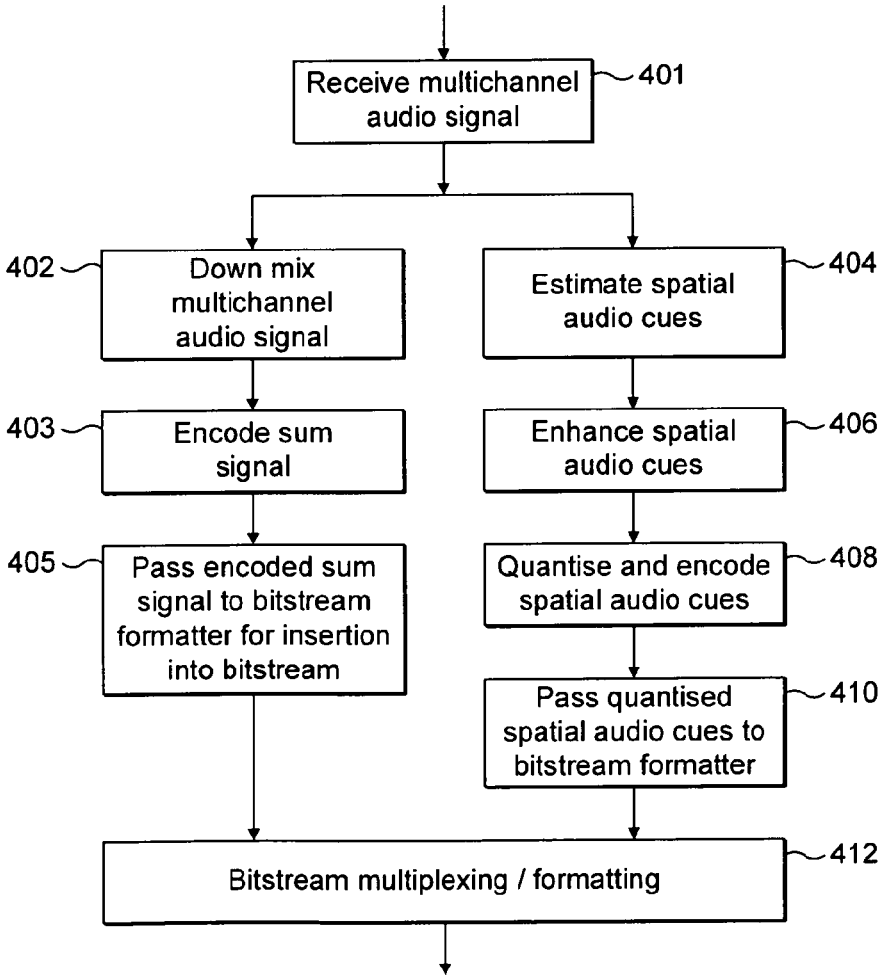
FIG. 4 shows a flow diagram illustrating the operation of the encoder according to embodiments of the invention.
Figure 9:
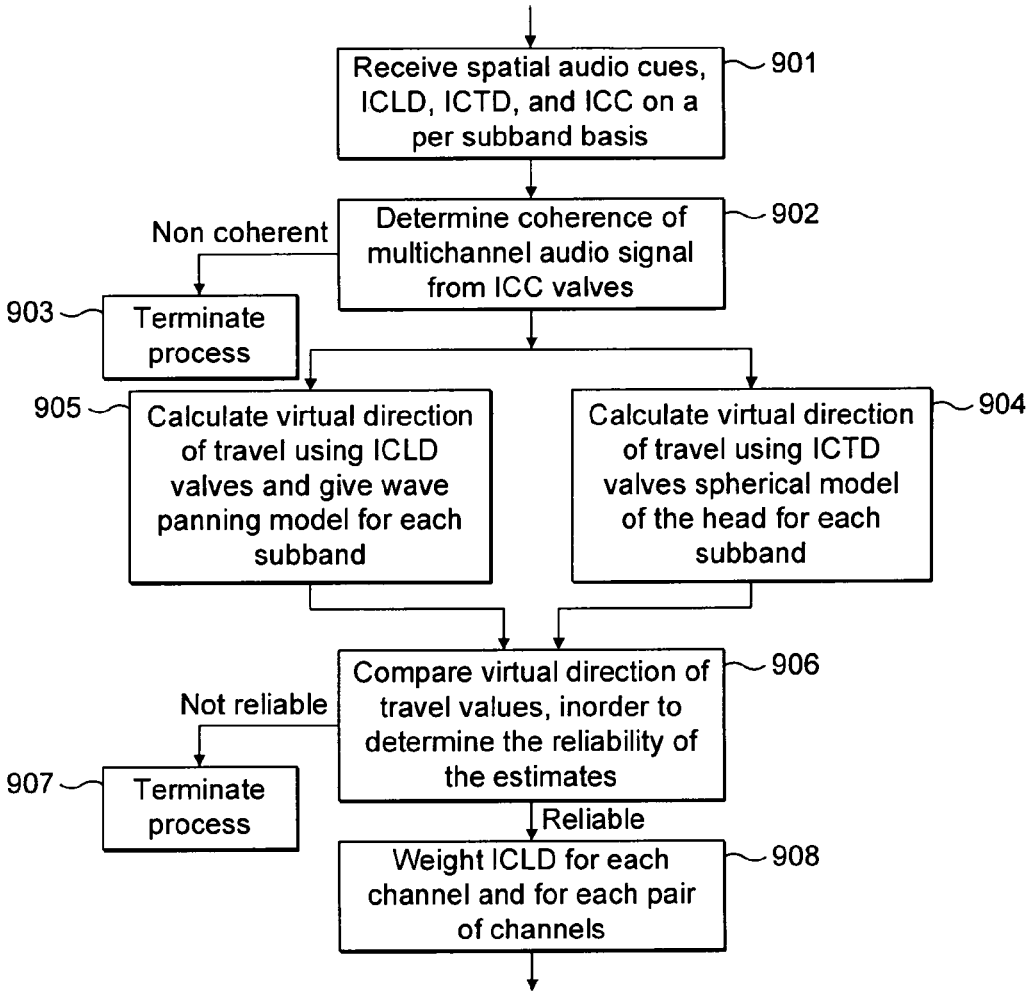
FIG. 9 shows a flow diagram illustrating in further detail the operation of the invention according to embodiments of the invention.
Figure 10:
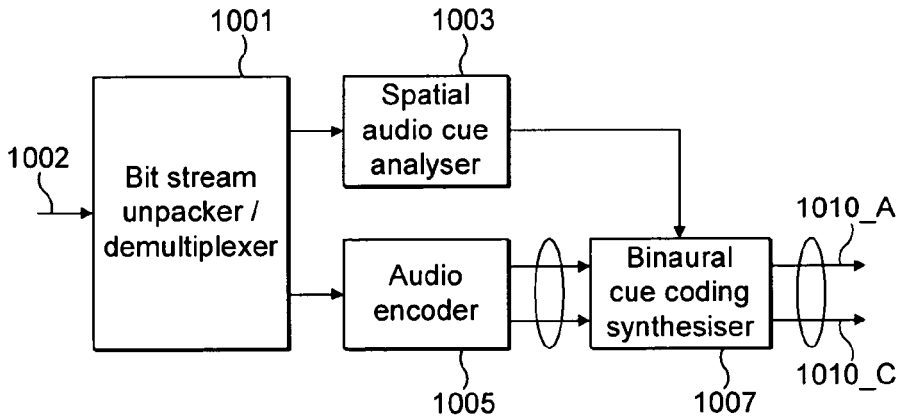
FIG. 10 shows schematically an audio decoder deploying a first embodiment of the invention.
Figure 11:
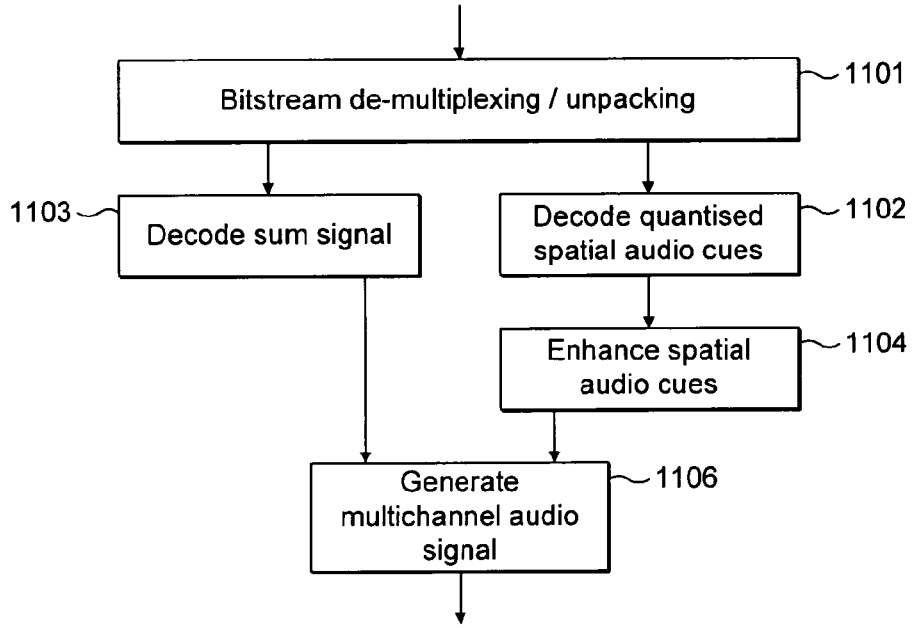
FIG. 11 shows a flow diagram illustrating the operation of the decoder according to embodiments of the invention.

It would be appreciated that the schematic structures described in FIGS. 2, 3, 5, 6, 10 and 12 and the method steps in FIGS. 4, 9, and 11 represent only a part of the operation of a complete audio codec comprising an embodiments of the invention as exemplarily shown implemented in the electronic device shown in FIG. 1.

The general operation of audio codecs as employed by embodiments of the invention is shown in FIG. 2. General audio coding/decoding systems consist of an encoder and a decoder, as illustrated schematically in FIG. 2. Illustrated is a system 102 with an encoder 104, a storage or media channel 106 and a decoder 108.

The encoder 104 compresses an input audio signal 110 producing a bit stream 112, which is either stored or transmitted through a media channel 106. The bit stream 112 can be received within the decoder 108. The decoder 108 decompresses the bit stream 112 and produces an output audio signal 114. The bit rate of the bit stream 112 and the quality of the output audio signal 114 in relation to the input signal 110 are the main features, which define the performance of the coding system 102.

FIG. 3 shows schematically an encoder 104 according to a first embodiment of the invention. The encoder 104 is depicted as comprising an input 302 divided into M channels. It is to be understood that the input 302 may be arranged to receive either an audio signal of M channels, or alternatively M audio signals from M individual audio sources. Each of the M channels of the input 302 may be connected to both a down mixer 303 and a spatial audio cue analyzer 305.

The down mixer 303 may be arranged to combine each of the M channels into a sum signal 304 comprising a representation of the sum of the individual audio input signals. In some embodiments of the invention the sum signal 304 may comprise a single channel. In other embodiments of the invention the sum signal 304 may comprise (a plurality of) E sum signal channels.

The sum signal output from the down mixer 303 may be connected to the input of an audio encoder 307. The audio decoder 307 may be configured to encode the audio sum signal and output a parameterised encoded audio stream 306.

The spatial audio cue analyzer 305 may be configured to accept the M channel audio input signal from the input 302 and generate as an output a spatial audio cue signal 308. The output signal from the spatial cue analyzer 305 may be arranged to be connected to the input of a bit stream formatter 309 (which in some embodiments of the invention may also known as the bitstream multiplexer).

In some embodiments of the invention there may be an additional output connection from the spatial audio cue analyzer 305 to the down mixer 303, whereby spatial audio cues such as the ICTD spatial audio cues may be fed back to the down mixer on order to remove the time difference between channels.

In addition to receiving the spatial cue information from the spatial cue analyzer 305, the bitstream formatter 309 may be further arranged to receive as an additional input the output from the audio encoder 307. The bitstream formatter 309 may then configured to output the output bitstream 112 via the output 310.

The operation of these components is described in more detail with reference to the flow chart in FIG. 4 showing the operation of the encoder.

The multichannel audio signal is received by the encoder 104 via the input 302. In a first embodiment of the invention the audio signal from each channel is a digitally sampled signal. In other embodiments of the present invention the audio input may comprise a plurality of analogue audio signal sources, for example from a plurality of microphones distributed within the audio space, which are analogue to digitally (A/D) converted. In further embodiments of the invention the multichannel audio input may be converted from a pulse code modulation digital signal to an amplitude modulation digital signal.

The receiving of the audio signal is shown in FIG. 4 by processing step 401.

The down mixer 303 receives the multichannel audio signal and combines the M input channels into a reduced number of channels E conveying the sum of the multichannel input signal. It is to be understood that the number of channels E to which the M input channels may be down mixed may comprise either a single channel or a plurality of channels.

In embodiments of the invention the down mixing may take the form of adding all the M input signals into a single channel comprising of the sum signal. In this example of an embodiment of the invention E may be equal to one.

In further embodiments of the invention the sum signal may be computed in the frequency domain, by first transforming each input channel into the frequency domain using a suitable time to frequency transform such as a discrete fourier transform (DFT).

Figure 5:
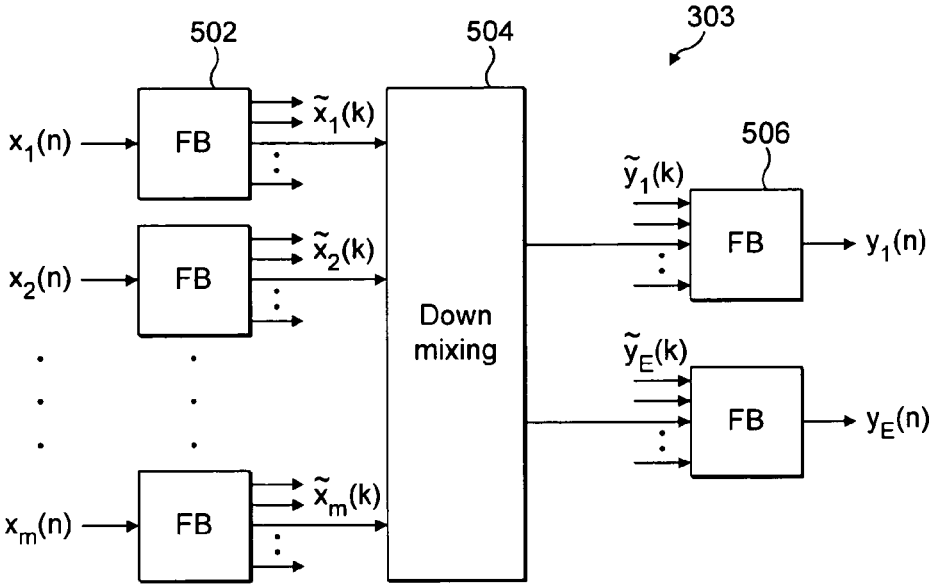
FIG. 5 shows schematically a down mixer according to embodiments of the invention.

FIG. 5 shows a block diagram depicting a generic M to E down mixer which may be used for the purposes of down mixing the multichannel input audio signal according to embodiments of the invention. The down mixer 303 in FIG. 5 is shown as having a filter bank 502 for each time domain input channel $x_i(n)$ where i is the input channel number for a time instance n. In addition the down mixer 303 is depicted as having a down mixing block 504, and finally an inverse filter bank 506 which may be used to generate the time domain signal for each output down mixed channel $y_i(n)$.

In embodiments of the invention each filter bank 502 may convert the time domain input for a specific channel $x_i(n)$ into a set of K sub bands. The set of sub bands for a particular channel i may be denoted as $\tilde{X}_i=[\tilde{x}_i(0),\tilde{x}(1), \ldots \tilde{x}_i(k), \ldots, \tilde{x}_i(K-1)]$ where $\tilde{x}_i(k)$ represents the individual sub band k. In total there may be M sets of K sub bands, one for each input channel. The M sets of K sub bands may be represented as $[\tilde{X}_0, \tilde{X}_1, \ldots, \tilde{X}_{M-1}]$.

In embodiments of the invention the down mixing block 504 may then down mix a particular sub band with the same index from each of the M sets of frequency coefficients in order to reduce the number of sets of sub bands from M to E. This may be accomplished by multiplying the particular $k^{th}$ sub band from each of the M sets of sub bands bearing the same index by a down mixing matrix in order to generate the $k^{th}$ sub band for the E output channels of the down mixed signal. In other words the reduction in the number of channels may be achieved by subjecting each sub band from a channel by matrix reduction operation. The mechanics of this operation may be represented by the following mathematical operation $$\begin{bmatrix} \tilde{y}_1(k) \\ \tilde{y}_2(k) \\ \vdots \\ \tilde{y}_E(k) \end{bmatrix} = D_{EM} \begin{bmatrix} \tilde{x}_1(k) \\ \tilde{x}_2(k) \\ \vdots \\ \tilde{x}_M(k) \end{bmatrix}$$

where $D_{EM}$ may be a real valued E by M matrix, $[\tilde{x}_1(k), \tilde{x}_2(k), \ldots, \tilde{x}_M(k)]$ denotes the $k^{th}$ sub band for each input sub band channel, and $[\tilde{y}_1(k), \tilde{y}_2(k), \ldots, \tilde{y}_E(k)]$ represents the $k^{th}$ sub band for each of the E output channels.

In other embodiments of the invention the $D_{EM}$ may be a complex valued E by M matrix. In embodiments such as these the matrix operation may additionally modify the phase of the domain transform domain coefficients in order to remove any inter channel time difference.

The output from the down mixing matrix $D_{EM}$ may therefore comprise of E channels, where each channel may consist of a sub band signal comprising of K. sub bands, in other words if $Y_i$ represents the output from the down mixer for a channel i at an input frame instance, then the sub bands which comprise the sub band signal for channel i may be represented as the set $[\tilde{y}_i(0), \tilde{y}_i(1), \ldots \tilde{y}_i(k-1)]$.

Once the down mixer has down mixed the number of channels from M to E, the K frequency coefficients associated with each of the E channels $\tilde{Y}_i=[\tilde{y}_i(0), \tilde{y}_i(1), \ldots, \tilde{y}_i(k), \ldots, \tilde{y}_i(K-1)]$ may be converted back to a time domain output channel signal $y_i(n)$ using an inverse filter bank as depicted in by 506 in FIG. 5, thereby enabling the use of any subsequent audio coding processing stages.

In yet further embodiments of the invention the frequency domain approach may be further enhanced by dividing the spectrum for each channel into a number of partitions. For each partition a weighting factor may be calculated comprising the ratio of the sum of the powers of the frequency components within each partition for each channel to the total power of the frequency components across all channels within each partition. The weighting factor calculated for each partition may then be applied to the frequency coefficients within the same partition across all M channels. Once the frequency coefficients for each channel have been suitably weighted by their respective partition weighting factors the weighted frequency components from each channel may be added together in order to generate the sum signal. The application of this approach may be implemented as a set of weighting factors for each channel and may be depicted as the optional scaling block placed in between the down mixing stage 504 and the inverse filter bank 506. By using this approach for combining and summing the various channels allowance is made for any attenuation and amplification effects that may be present when combining groups of inter related channels. Further details of this approach may be found in the IEEE publication Transactions on Speech and Audio Processing, Vol. 11, No 6 November 2003 entitled, Binaural Cue Coding—Part II: Schemes and Applications, by Christof Faller and Frank Baumgate.

The down mixing and summing of the input audio channels into a sum signal is depicted as processing step 402 in FIG. 4.

The spatial cue analyzer 305 may receive as an input the multichannel audio signal. The spatial cue analyzer may then use these inputs in order to generate the set of spatial audio cues which in embodiments of the invention may consist of the Inter channel time difference (ICTD), inter channel level difference (ICLD) and the inter channel coherence (ICC) cues.

In embodiments of the invention stereo and multichannel audio signals usually contain a complex mix of concurrently active source signals superimposed by reflected signal components from recording in enclosed spaces. Different source signals and their reflections occupy different regions in the time-frequency plane. This may be reflected by ICTD, ICLD and ICC values, which may vary as functions of frequency and time. In order to exploit these variations it may be advantageous to analyse the relation between the various auditory cues in a sub band domain.

In embodiments of the invention the frequency dependence of the spatial audio cues ICTD, ICLD and ICC present in a multichannel audio signal may be estimated in a sub band domain and at regular instances in time.

The estimation of the spatial audio cues may be realised in the spatial cue analyzer 305 by using a fourier transform based filter bank analysis. In this embodiment a decomposition of the audio signal for each channel may be achieved by using a block-wise short time fast fourier transform (FFT) with a 50% overlapping analysis window structure. The FFT spectrum may then be divided by the spectral analyzer 305 into non overlapping bands. In such embodiments of the invention the frequency coefficients may be distributed to each band according to the psychoacoustic critical band structure, whereby bands in the lower frequency region may be allocated fewer frequency coefficients than bands situated in a higher frequency region.

In other embodiments of the invention the frequency bands for each channel may be grouped in accordance with a linear scale, whereby the number of coefficients for each channel may be apportioned equally to each sub band.

In further embodiments of the invention decomposition of the audio signal for each channel may be achieved using a quadrature mirror filter (QMF) with sub bands proportional to the critical bandwidth of the human auditory system.

The spatial cue analyzer may then calculate an estimate of the power of the frequency components within a sub band for each channel. In embodiments of the invention this may be achieved for complex fourier coefficients by calculating the modulus of each coefficient and then summing the square of the modulus for all coefficients within the sub band. These power estimates may be used as the basis by which the spatial analyzer 305 calculates the audio spatial cues.

Figure 6:
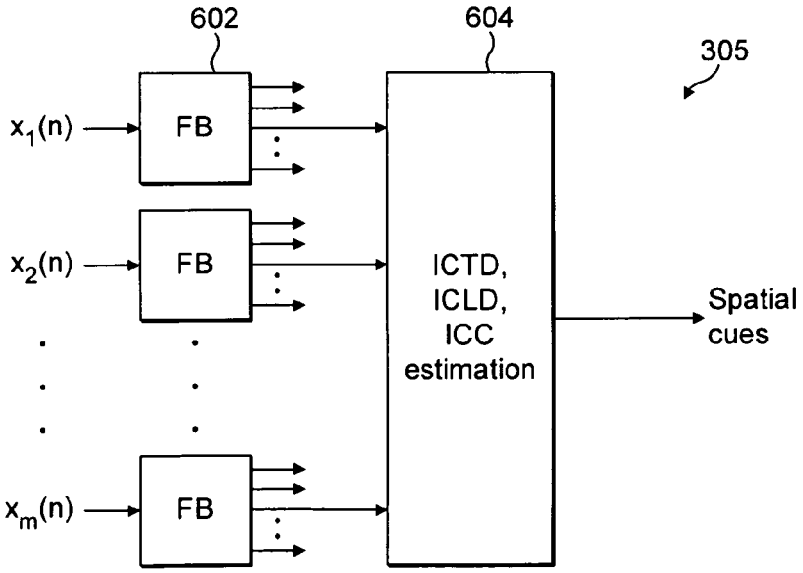
FIG. 6 shows schematically a spatial audio cue analyzer according to embodiments of the invention.

FIG. 6 depicts a structure which may be used to generate the spatial audio cues from the multichannel input signal. In FIG. 6 a time domain input channel may be represented as $x_i(n)$ where i is the input channel number and n is an instance in time. The sub band output from the filter bank (FB) 602 for each channel may be depicted as the set $[\tilde{x}_i(0), \tilde{x}_i(1), \ldots, \tilde{x}_i(k), \ldots, \tilde{x}_i(K-1)]$ where $\tilde{x}_i(k)$ represents the individual sub band k for a channel i.

It is to be understood that all subsequent processing steps are performed on the input audio signal on a per sub band basis.

In one embodiment of the invention which deploys a stereo or two channel input to the encoder 104, the ICLD between the left and right channel for each sub band may be given by the ratio of the respective powers estimates. For example, the ICLD between the first and second channel $\Delta L_{12}(k)$ for the corresponding sub band signals $\tilde{x}_1(k)$ and $\tilde{x}_2(k)$ of the two audio channels, denoted by indices 1 and 2 with a sub band index k may be given in decibels as $$\Delta L_{12}(k) = 10\log_{10}\left(\frac{p_{\tilde{x}_2}(k)}{p_{\tilde{x}_1}(k)}\right)$$

where $p_{\tilde{x}_2}(k)$ and $p_{\tilde{x}_1}(k)$ are short time estimates of the power of the signals $\tilde{x}_1(k)$ and $\tilde{x}_2(k)$ for a sub band k, respectively.

Further, in this embodiment of the invention the ICTD between the left and right channels for each sub band may also be determined from the power estimates for each sub band. For example, the ICTD between the first and second channel $\tau_{12}(k)$ may be determined from $$\tau_{12}(k) = \underset{d}{\operatorname{argmax}}\{\Phi_{12}(d, k)\}$$

where $\Phi_{12}$ is the normalised cross correlation function, which may be calculated from $$\Phi_{12}(d, k) = \frac{p_{\tilde{x}_1\tilde{x}_2}(d, k)}{\sqrt{p_{\tilde{x}_1}(k-d_1)p_{\tilde{x}_2}(k-d_2)}}$$

where $d_1=\max\{-d,0\}$ and $d_2=\max\{d,0\}$ and $p_{\tilde{x}_1\tilde{x}_2}(d,k)$ is a short-time estimate of the mean of $\tilde{x}_1(k-d_1)\tilde{x}_2(k-d_2)$. In other words the relative delay d between the two signals $\tilde{x}_1(k)$ and $\tilde{x}_2(k)$ may be adjusted until a maximum value for the normalised cross correlation is obtained. The value of d at which a maximum for the normalised cross correlation function may be obtained is deemed to be the ICTD between the two signals $\tilde{x}_1(k)$ and $\tilde{x}_2(k)$ for the sub band k.

Further still in this embodiment, the ICC between the two signals may also be determined by considering the normalised cross correlation function $\Phi_{12}$. For example the ICC $c_{12}$ between the two signals $\tilde{x}_1(k)$ and $\tilde{x}_2(k)$ may be determined according to the following expression $$c_{12} = \max_d |\phi_{12}(d, k)|$$

In other words the ICC may be determined to be the maximum of the normalised correlation between the two signals for different values of delay d between the two signals $\tilde{x}_1(k)$ and $\tilde{x}_2(k)$ for a sub band k.

In embodiments of the invention the ICC data may correspond to the coherence of the binaural signal. In other words the ICC may be related to the perceived width of the audio source, so that if an audio source is perceived to be wide then the corresponding coherence between the left and right channels may be lower when compared to an audio source which is perceived to be narrow. For example, the coherence of a binaural signal corresponding to an orchestra may be typically lower than the coherence of a binaural signal corresponding to a single violin. Therefore in general an audio signal with a lower coherence may be perceived to be more spread out in the auditory space.

Further embodiments of the invention may deploy multiple input audio signals comprising more than two channels into the encoder 104. In these embodiments it may be sufficient to define the ICTD and ICLD values between a reference channel, for example channel 1, and each other channel in turn.

Figure 7:
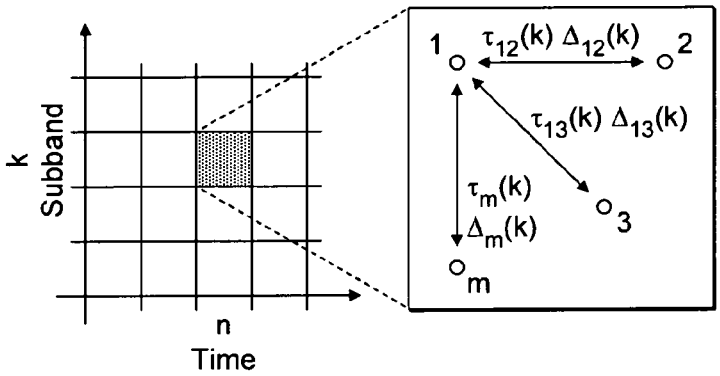
FIG. 7 shows an illustration depicting the distribution of ICTD and ICLD values for each channel of a multichannel audio signal system comprising M input channels.

FIG. 7 illustrates an example of a multichannel audio signal system comprising M input channels for a time instance n and for a sub band k. In this example the distribution of ICTD and ICLD values for each channel are relative to channel 1 whereby for a particular sub band k, $\tau_{1i}(k)$ and $\Delta L_{1i}(k)$ denotes the ICTD and ICLD values between the reference channel 1 and the channel i.

In the embodiments of the invention which deploy an audio signal comprising of more than two input channels a single ICC parameter per sub band k may be used in order to represent the overall coherence between all the audio channels for a sub band k. This may be achieved by estimating the ICC cue between the two channels with the greatest energy on a per each sub band basis.

The process of estimating the spatial audio cues is depicted as processing step 404 in FIG. 4.

The spatial audio cue analyzer 305 may use the spatial audio cues calculated from the previous processing, step in order to enhance the spatial image for sounds which are deemed to have a high degree of coherence. The spatial image enhancement may take the form of adjusting the relative difference in audio signal strengths between the channels such that the audio sound may appear to the listener to be moved away from the centre of the audio image. The effect of adjusting the relative difference in audio signal strengths may be illustrated with respect to FIG. 8, in which a human head may receive sound from two individual sources, source 1 and source 2, whereby the angles of the two sources relative to the centre line of the head are given by $\theta_0$ and $-\theta_0$ respectively. In this particular illustration the audio signals emanating from the sources 1 and 2 are combined to produce the effect of a virtual source whose perceived or virtual audio signal may have a direction of arrival to the head of θ degrees. It may be seen the direction of arrival θ may be dependent on the relative strengths of the audio sources 1 and 2. Further, by adjusting the relative signal strengths of the audio sources 1 and 2 the direction of arrival of the virtual audio signal may appear to be changed in the auditory space.

It is to be understood that the direction of arrival θ to the head of the virtual audio signal may be considered from the aspect of the combinatorial effect of a number of audio signals, whereby each audio signal emanates from an audio source located in the audio space.

It is to be further understood that the virtual audio signal may therefore be considered as composite audio signal whose components comprise a number of individual audio signals.

In embodiments of the invention the spatial audio cue analyzer 305 may calculate the direction of arrival to the head of the composite or virtual audio signal to on a per sub band basis. In these embodiments of the invention the direction of arrival to the head of the composite audio signal to the head may be represented for a particular sub band as $\theta_k$, where k is a particular sub band.

To further assist the understanding of the invention the process of enhancing the spatial audio cues by the spatial audio cue analyzer 305 is described in more detail with reference to the flow chart in FIG. 9.

The step of receiving the calculated spatial audio cues on a per sub band basis from the processing step 404 as shown in FIG. 4 is depicted as processing step 901 in FIG. 9.

Firstly, in embodiments of the invention the ICC parameter for a sub band k may be analysed in order to determine if the multichannel audio signal associated with the sub band k may be classified as a coherent signal. This classification may be determined by ascertaining if the value of the normalised correlation coefficient associated with the ICC parameter indicates that a strong correlation exists between the channels. Typically in embodiments of the invention this may be indicated by a normalised correlation coefficient which has a value near or approximating one.

The step of determining the degree of coherence of the multi channel audio signal for a particular sub band is shown as processing step 902.

According to embodiments of the invention, if the result of the coherent determining classification step indicates that the multi channel audio signal is not coherent for a particular sub band then the spatial audio image enhancement procedure is terminated for that particular sub band. However, if the coherent determining classification step indicates that the multichannel audio signal is coherent for the particular sub band then the audio spatial cue analyzer 305 may further analyse the spatial audio cue parameters.

The process of terminating the spatial audio image enhancement procedure for a sub band of the audio signal which is deemed to be non coherent is shown as step 903 in FIG. 9.

In embodiments of the invention the direction of arrival $\theta_k$ to the head of a virtual audio signal per sub band may be determined using a spherical model of the head.

In general the spherical model of the head may be expressed in terms of the relationship between the time difference τ of an audio signal arriving at the left and right ears of the human head, and the direction of arrival to the head θ of the audio signal emanating from one or more audio sources, in other words the composite or virtual audio signal. The relationship may be determined to be $$\tau = \frac{D}{2c}(\theta + \sin(\theta))\Big)$$

where D is a known constant which represents the distance between the ears and c is the speed of sound.

It is to be understood that in considering the spherical model of the head, the direction of arrival to the head θ of the virtual audio signal may be considered from the point of view of a pair of audio sources located in the audio space, whereby the audio signals emanating from the pair of audio sources combine to form an audio signal which may appear to the listener as a virtual audio signal emanating from a single (virtual) source.

It is to be further understood that the parameter τ may be represented as the relative time difference between the signals from the respective sources.

In embodiments of the invention the direction of arrival to the head of the virtual audio signal may be determined on a per sub band basis. This may be accomplished by using the ICTD parameter for the particular sub band in order to represent the value of the time difference for signals arriving at the left and right ears τ. The direction of arrival $\theta_k$ for a sub band k of the virtual audio signal may be expressed according to the following equation $$\tau_{12}(k) = \frac{D}{2c}(\theta_k + \sin(\theta_k))\Big)$$

In embodiments of the invention a practical implementation of the above equation may involve formulating a mapping table, whereby a plurality of time differences or ICLD parameter values may be cross matched to corresponding values for the direction of arrival $\theta_k$.

In further embodiments of the invention the direction of arrival to the head of a virtual audio signal derived from a number of audio sources greater than two may also be determined using the spherical model of the head. In these embodiments of the invention the direction of arrival to the head for a particular sub band k may be determined by considering the ICTD parameter between a series of pairs of channels. For example the direction of arrival to the head may be calculated for each sub band between a reference channel and a general channel, in other words the time difference τ may be derived from the relative delay between the reference channel 1 for instance and a channel i; that is $\tau_{1i}(k)$.

The process for determining the direction of arrival of the virtual audio signal derived from audio signals emanating from a plurality of audio sources using the spherical model of the head may be depicted as processing step 904 in FIG. 9.

Figure 8:
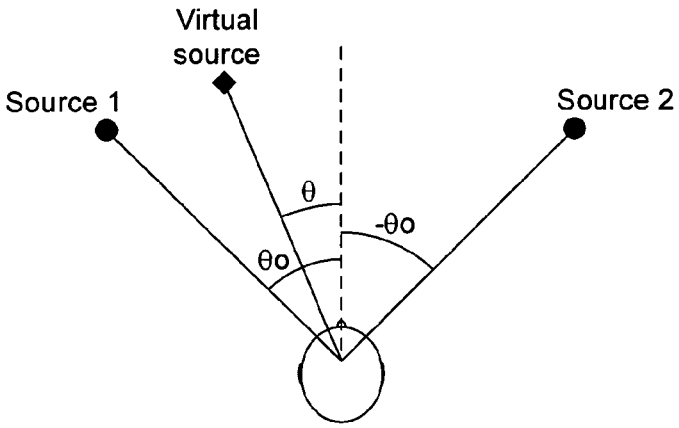
FIG. 8 shows an illustration depicting an example of a virtual sound source position using two sound sources.

In embodiments of the invention the direction of arrival θ may also be determined by considering the panning law associated with two sound sources such as those depicted in FIG. 8. One such form of this law may be determined by considering the relationship between the amplitude of the two sound sources and the sine of the angles of the respective sources relative to the listener. This form of the law is known as the sine wave panning law and may be formulated as $$\frac{\sin\theta}{\sin\theta_0} = \frac{g_1 - g_2}{g_1 + g_2}$$

where $g_1$ and $g_2$ are the amplitude values (or signal strength values) for the two sound sources 1 and 2 (or left and right channels respectively), $\theta_0$ and $-\theta_0$ are their respective directions of arrival relative to the head or the listener. The direction of arrival of the virtual audio signal formed by the combinatorial effects of sound sources 1 and 2 may be expressed as θ in the above equation.

It is to be understood that if the two sound sources 1 and 2 constitute the left and right channels of a pair of headphones then the sine wave panning law may be further simplified by noting that $\sin\theta_0=1$ in this instance.

It is to be further understood that in embodiments of the invention the sine wave panning law may be applied on a per sub band basis as before. In other words the directional of arrival may be expressed on a per sub band basis and may be denoted by $\theta_k$ for a particular sub band k.

In such embodiments of the invention the amplitude values $g_1$ and $g_2$ may be derived from the ICLD parameters calculated for each sub band k according to $$g_1(k)=\frac{1}{2}\frac{\Delta L_{12}(k)}{\Delta L_{12}(k)+1} \text{ and } g_2(k)=\frac{1}{2}\frac{1}{\Delta L_{12}(k)+1}$$

where $\Delta L_{12}(k)$ denotes the ICLD parameter between the channel pair corresponding to audio sources 1 and 2 for the sub band k.

In embodiments of the invention the direction of arrival of a virtual audio signal $\theta_k$ for a sub band k may be generated from the following equation $$\sin\theta_k=\frac{g_1(k)-g_2(k)}{g_1(k)+g_2(k)}\cdot\sin\theta_0$$

It is to be understood that the parameter $\theta_0$ to the positioning of the sound sources relative to the listener, and in the audio space the positioning of the sound sources may be pre determined and constant, for example the relative position of a pair of loudspeakers in a room.

The process of determining the direction of arrival of a virtual audio signal using the sine wave panning law model may be depicted as processing step 905 in FIG. 9.

The spatial analyzer 305 may then estimate the reliability of the direction of arrival $\theta_k$ for each sub band k. In embodiments of the invention this may be accomplished by forming a reliability estimate. The reliability estimate may be formed by comparing the direction of arrival obtained from the ICTD based spherical model of the head with the direction of arrival obtained from the ICLD based sine wave panning law model. If the two independently derived estimates for the direction of arrival for a particular sub band are within a pre determined error bound, the resulting reliability estimate may indicate that the direction of arrival is reliable and either one of the two values may be used in subsequent processing steps.

It is to be understood that the direction of arrival for each sub band k may be individually assessed for reliability.

The process of determining the reliability of the direction of travel from a virtual audio source for each sub band may be depicted as processing step 906 in FIG. 9.

The spatial cue analyzer 305 may then determine if the spatial image warrants enhancing.

In embodiments of the invention this may be done according to the criteria that the multichannel audio signal may be determined to be coherent and the direction of arrival estimate of the virtual audio source may be deemed reliable.

It is to be understood in embodiments of the invention determining if the spatial image warrants enhancing may be performed on a per sub band basis and in these embodiments each sub band may have a different value for the direction of arrival estimate.

In embodiments of the invention, if the direction of arrival estimate is deemed unreliable then the spatial audio cue enhancement process may be terminated.

It is to be understood in embodiments of the invention that the direction of arrival estimate may be deemed unreliable per sub band basis and consequently the spatial audio cue enhancement process may be terminated on a per sub band basis.

The termination of the audio spatial cue enhancement process due to unreliable direction of travel estimates on a per sub band basis is shown as processing step 907 in FIG. 9.

Weighting the ICLD has the effect of moving the centre of the audio image by amplitude panning. In other words the direction of arrival of the audio signal for a particular sub band may be changed such that it appears to have been moved more towards the periphery of the audio space.

In embodiments of the invention this weighting may be achieved by scaling the ICLD for a particular sub band k according to the following relationship $$\log_{10}\Delta\tilde{L}_{12}(k)=\lambda\log_{10}\Delta L_{12}(k)$$

where $\lambda$ is the desired scaling factor which may be used to scale the ICLD parameter $\Delta L_{12}(k)$ between two audio sources for a particular sub band k, and $\Delta\tilde{L}_{12}(k)$ represents the corresponding scaled ICLD.

In typical embodiments of the invention the scaling factor $\lambda$ may take the value in the range $\lambda=[1.0, \ldots, 2.0]$. Whereby the greater the scaling factor then the further the sound may be panned away from the centre of the audio image.

In further embodiments of the invention the magnitude of the scaling factor may be controlled by the ICTD based direction of travel estimate from the virtual source for a sub band. In other words the estimate of the direction of travel derived which may be derived from the spherical model of the head. An example of such an embodiment may comprise applying a scaling factor $\lambda$ in the range [1.0, . . . , 2.0] if the ICTD estimate of the direction of arrival is in the range of ±[30°, . . . , 60°], and applying a scaling factor $\lambda$ in the further range [2.0, . . . , 4.0] if the ICTD estimate of the direction of arrival is in the range of ±[60°, . . . , 90°].

The process of weighting the ICLD for each sub band and pair of channels is shown as processing step 908 in FIG. 9.

It is to be understood that processing steps 901 to 908 may be repeated for each sub band of the multichannel audio signal. Consequently the ICLD parameter associated with each sub band may be individually enhanced according to the criteria that the particular multichannel sub band signal is coherent and the direction of arrival of the equivalent virtual audio signal associated with the sub band is estimated to be reliable.

The process of enhancing spatial audio cues is depicted as processing step 406 in FIG. 4.

Upon completion of any weighting of the spatial audio cue the spatial cue analyzer 305 may then be arranged to quantise and code the auditory cue information in order to form the side information in preparation for either storage in a store and forward type device or for transmission to the corresponding decoding system.

In embodiments of the invention the ICLD and ICTD for each sub band may be naturally limited according to the dynamics of the audio signal. For example, the ICLD may be limited to a range of $\pm\Delta L_{max}$ where $\Delta L_{max}$ may be 18 dB, and the ICTD may be limited to a range of $\pm\tau_{max}$ where $\tau_{max}$ max may correspond to 800 μs. Further the ICC may not require any limiting since the parameter may be formed of normalised correlation which has a range between 0 and 1.

After limiting the spatial auditory cues the spatial analyzer 305 may be further arranged to quantize the estimated inter channel cues using uniform quantizers. The quantized values of the estimated inter channel cues may then be represented as a quantization index in order to facilitate the transmission and storage of the inter channel cue information.

In some embodiments of the invention the quantisation indices representing the inter channel cue side information may be further encoded using run length encoding techniques such as Huffman encoding in order to improve the overall coding efficiency.

The process of quantising and encoding the spatial audio cues is depicted as processing step 408 in FIG. 4.

The spatial cue analyzer 305 may then pass the quantization indices representing the inter channel cue as side information to the bit stream formatter 309. This is depicted as processing step 410 in FIG. 4.

In embodiments of the invention the sum signal output from the down mixer 303 may be connected to the input of an audio encoder 307. The audio encoder 307 may be configured to code the sum signal in the frequency domain by transforming the signal using a suitably deployed orthogonal based time to frequency transform, such as a modified discrete cosine transform (MDCT) or a discrete fourier transform (DFT). The resulting frequency domain transformed signal may then be divided into a number or sub bands, whereby the allocation of frequency coefficients to each sub band may be apportioned according to psychoacoustic principles. The frequency coefficients may then be quantised on a per sub band basis. In some embodiments of the invention the frequency coefficients per sub band may be quantised using a psychoacoustic noise related quantisation levels in order to determine the optimum number of bits to allocate to the frequency coefficient in question. These techniques generally entail calculating a psychoacoustic noise threshold for each sub band, and then allocating sufficient bits for each frequency coefficient within the sub band in order ensure that the quantisation noise remains below the pre calculated psychoacoustic noise threshold. In order to obtain further compression of the audio signal, audio encoders such as those represented by 307 may deploy run length encoding on the resulting bit stream. Examples of audio encoders represented by 307 known within the art may include the Moving Pictures Expert Group Advanced Audio Coding (AAC) or the MPEG1 Layer III (MP3) coder.

The process of audio encoding of the sum signal is depicted as processing step 403 in FIG. 4.

The audio encoder 307 may then pass the quantization indices associated with the coded sum signal to the bit stream formatter 309. This is depicted as processing step 405 in FIG. 4.

The bitstream formatter 309 may be arranged to receive the coded sum signal output from the audio encoder 307 and the coded inter channel cue side information from the spatial cue analyzer 305. The bitstream formatter 309 may then be further arranged to format the received bitstreams to produce the bitstream output 112

In some embodiments of the invention the bitstream formatter 234 may interleave the received inputs and may generate error detecting and error correcting codes to be inserted into the bitstream output 112.

The process of multiplexing and formatting the bitstreams for either transmission or storage is shown as processing step 412 in FIG. 4.

To further assist the understanding of the invention the operation of the decoder 108 implementing embodiments of the invention is shown in FIG. 10. The decoder 108 receives the encoded signal stream 112 comprising the encoded sum signal and encoded auditory cue information and outputs a reconstructed audio signal 114.

In embodiments of the invention the reconstructed audio signal 114 may comprise multiple output channels N. Whereby the number of output channels N may be equal to or less than the number of input channels M into the encoder 104.

The decoder comprises an input 1002 by which the encoded bitstream 112 may be received. The input 1002 may be connected to a bitstream unpacker or de multiplexer 1001 which may receive the encoded signal and output the encoded sum signal and encoded auditory cue information as two separate streams. The bitstream unpacker may be connected to a spatial audio cue processor 1003 for the passing of the encoded auditory cue information. The bitstream unpacker may also be connected to an audio decoder 1005 for the passing of the encoded sum signal. The output from the audio decoder 1005 may be connected to the binaural cue coding synthesiser 1007, in addition the binaural cue synthesiser may receive and additional input from the spatial audio cue processor 1003. Finally the N channel output 1010 from the binaural cue coding (BCC) synthesiser 1007 may be connected to the output of the decoder.

The operation of these components is described in more detail with reference to the flow chart in FIG. 11 showing the operation of the decoder.

The process of unpacking the received bitstream is depicted as processing step 1101 in FIG. 11.

The audio decoder 1005 may receive the audio encoded sum signal bit stream from the bitstream unpacker 1001 and then proceed to decode the encoded sum signal in order to obtain the time domain representation of the sum signal. The decoding process may typically involve the inverse to the process which is used for the audio encoding stage 307 as part of the encoder 104.

In embodiments of the invention the audio decoder 1005 may involve a dequantisation process whereby the quantised frequency and energy coefficients associated with each sub band are reformulated. The audio decoder may then seek to re-scale and re-order the de-quantised frequency coefficients in order to reconstruct the frequency spectrum of the audio signal. Further, the audio decoding stage may incorporate further signal processing tools such as temporal noise shaping, or perceptual noise shaping in order to improve the perceived quality of the output audio signal. Finally the audio decoding process may transform the signal back into the time domain by employing the inverse of the orthogonal unitary transform applied at the encoder, typical examples may include an inverse modified discrete transform (IMDCT) and an inverse discrete fourier transform (IDFT).

It is to be understood that in embodiments of the invention the output of the audio decoding stage may comprise a decoded sum signal consisting of one or more channels, where the number of channels E being determined by the number of (down mixed audio) channels at the output of the down mixer 303 at the encoder 104.

The process of decoding the sum signal using the audio decoder 1005 is shown as processing step 1103 in FIG. 11.

The spatial audio cue processor 1003 may receive the encoded spatial audio cue information from the bitstream unpacker 1001. Initially the spatial audio cue processor 1003 may perform the inverse of the quantisation and indexing operation performed at the encoder in order to obtain the quantised spatial audio cues. The output of the inverse quantisation and indexing operation may provide for the ICTD, ICLD and ICC spatial audio cues.

The process of decoding the quantised spatial audio cues within the spatial audio cue processor is shown as processing step 1102 in FIG. 11.

The spatial cue processor 1003 may then apply the same weighting techniques on the quantised spatial audio cues as deployed at the encoder in order to enhance the spatial image for sounds which are coherent in nature. The enhancement may be performed before the spatial audio cues are passed to subsequent processing stages.

As before in embodiments of the invention the enhancement may take the form of adjusting ICLD values such that perceived audio sound is moved away from the centre of the audio image, and that the level of adjustment may be in accordance with the direction of arrival of an virtual audio signal from a derived from a plurality of audio signals emanating from a plurality of audio sources.

As before, it is to be understood the spatial audio cues are produced on a per sub band basis and therefore accordingly the spatial cue processor may also calculate the direction of arrival on a per sub band basis.

As before, for embodiments of the invention, the direction of arrival of a virtual audio signal may be determined using the spherical model of the head on a per sub band basis.

In further embodiments of the invention, the direction of arrival of a virtual audio signal may also be determined from the sine wave panning law on a per sub band basis.

The spatial processor 1003 may then assess the reliability of the direction of arrival of the virtual sound estimates for each sub band.

In embodiments of the invention this may be done by comparing the direction of arrival estimates obtained from using the ICTD values within the spherical model of the head to those results obtained by using the ICLD values within the sine panning law. If the two estimates for the direction of arrival of a virtual audio signal are within a pre determined error bound from each other, then the estimates may be considered reliable.

In embodiments of the invention the comparison between the two independently obtained direction of arrival estimates may be performed on a per sub band basis, whereby each sub band k may have an estimate of the reliability to the direction of arrival.

As before the spatial cue processor 1003 may then determine if the spatial image warrants enhancing. In embodiments of the invention this may be done according to the criteria that the multichannel audio signal may be determined to be coherent and the direction of arrival estimate of a virtual audio signal is deemed reliable.

In embodiments of the invention the degree of coherence of the audio signal may be determined from the ICC parameter. In other words if the value of the ICC parameter indicates that the audio signal is correlated then the signal may be determined to be coherent, Should the spatial cue analyzer 1003 determine that the spatial image warrants enhancing the weighting factor $\lambda$ may then be applied to the ICLD within each sub band k.

As before in embodiments of the invention the weighting may be achieved by scaling the ICLD of a particular sub band k according to the previously disclosed relationship $$\log_{10} \Delta\tilde{L}_{12}(k)=\lambda \log_{10} \Delta L_{12}(k)$$

where $\lambda$ is the desired scaling factor which may be used to scale the ICLD parameter $\Delta L_{12}(k)$ for a particular sub band, and $\Delta\tilde{L}_{12}(k)$ represents the scaled ICLD.

As before in embodiments of the invention the scaling factor $\lambda$ may take a range of values as previously described for the encoder, whereby the greater the scaling factor then the further the sound may be panned away from the centre of the audio image.

In further embodiments of the invention the magnitude of the scaling factor may also be controlled by the ICTD based direction of travel estimate from the virtual source, as previously disclosed for the encoder.

As before, this weighting of the ICLD per sub band has the effect of moving the centre of the audio image by amplitude panning. In other words the direction of travel of the virtual audio source for a particular sub band maybe changed such that it appears more towards the periphery of the audio space.

It is to be understood that in embodiments of the invention application of the technique of scaling of the ICLD parameter for each sub band within the spatial audio cue processor at the decoder may not be dependent on the equivalent scaling technique occurring in the corresponding encoding structure.

Furthermore, it is to be appreciated that in embodiments of the invention scaling of the ICLD parameters in order to achieve enhancement of the spatial audio image may occur independently in either the encoder or decoder.

The process of enhancing spatial audio cues at the decoder according to embodiments of the invention is shown as processing step 1104 in FIG. 11.

The spatial cue processor 1005 may then pass the set of decoded and optionally enhanced spatial audio cue parameters to the BCC synthesiser 1007.

In addition to receiving the decoded spatial audio cue parameters from the spatial cue processor 1005 the BCC synthesiser 1007 may also receive the time domain sum signal from the audio decoder 1003. The BCC synthesiser 1007 may then proceed to synthesis the multi channel output 1010 by using the sum signal from the audio decoder 1003 and the set of spatial audio cues from the spatial audio cue processor 1005.

Figure 12:
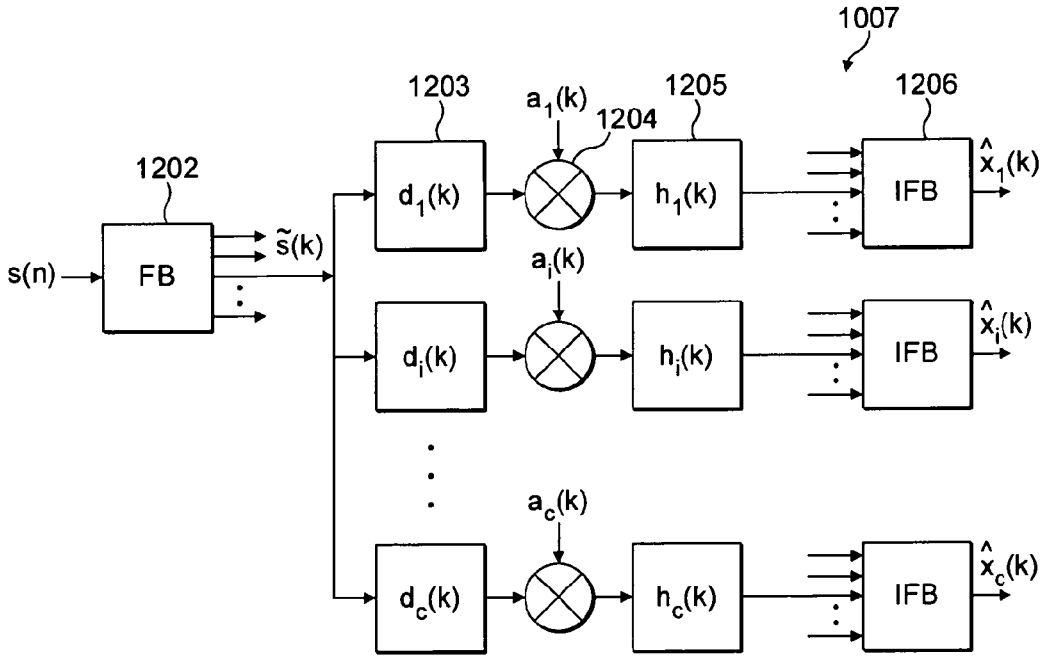
FIG. 12 shows schematically a binaural cue coding synthesiser according to embodiments of the invention

FIG. 12 shows a block diagram of the BCC synthesiser 1007 according to an embodiment of the invention. The input sum signal s(n) may be decomposed into a number of K sub bands by the filter bank (FB) 1202, where an individual sub band may be denoted by $\tilde{s}(k)$ and the set of K sub bands may be denoted by $S=[\tilde{s}(1), \tilde{s}(2), \ldots, \tilde{s}(k), \ldots, \tilde{s}(K)]$. The multiple output channels generated by the BCC synthesiser may be formed by generating for each output channel a set of K sub bands. The generation of each set of output channel sub bands may take the form of subjecting each sub band $\tilde{s}(k)$ of the sum signal to the ICTD, ICLD and ICC parameters associated with the particular output channel for which the signal is being generated.

In embodiments of the invention the ICTD parameters represents the delay of the channel relative to the reference channel. For example the delay $d_i(k)$ for a sub band k corresponding to an output channel i may be determined from the ICTD $\tau_{1i}(k)$ representing the delay between the reference channel 1 and the channel i for each sub band k. The delay $d_i(k)$ for a sub band k and output channel i may be represented as a delay block 1203 in FIG. 12.

In embodiments of the invention ICLD parameters represents the difference in magnitude between a channel i and its reference channel. For example the gain $a_i(k)$ for a sub band k corresponding to an output channel c may be determined from the ICLD $\Delta_{ic}(k)$ representing the magnitude difference between the reference channel 1 and the channel i for a sub band k. The gain $a_i(k)$ for a sub band k and output channel i may be represented as a multiplier 1204 in FIG. 12.

In some embodiments of the invention, the objective of ICC synthesis is to reduce correlation between the sub bands after the delay and scaling factors nave been applied to the particular sub bands corresponding to the channel in question. This may be achieved by employing filters 1205 in each sub band k for each output channel i, whereby the filters may be designed with coefficients $h_i(k)$ such that the ICTD and ICLD are varied as a function of frequency in order that the average variation is zero in each sub band. In these embodiments of the invention the impulse response of such filters may be drawn from a gaussian white noise source thereby ensuring that as little correlation as possible exists between the sub bands.

In further embodiments of the invention it may be advantageous for output sub band signals to exhibit a degree of inter channel coherence as transmitted from the encoder. In such embodiments the locally generated gains may be adjusted such that the normalised correlation for the power estimates of the locally generated channel signals between for each sub band correspond to received ICC value. This method is described in more in the IEEE publication Transactions on Speech and audio processing entitled "Parametric multichannel audio coding: Synthesis of coherence cues" by C. Faller.

Finally the K sub bands generated for each of the output channels (1 to C) may be converted back to a time domain output channel signal $\tilde{x}_i(n)$ by using an inverse filter bank as depicted in by 1206 in FIG. 12.

In some embodiments of the invention the number of output channels C may be equal to the number of input channels to the encoder M, this may be accomplished by deploying the spatial audio cues associated with each of the input channels. In other embodiments of the invention the number of output channels C may be less than the number of input channels m to the encoder 104. In these embodiments the output channels from the decoder 108 may be generated using a subset of the spatial audio cues determined for each channel at the encoder.

In some embodiments of the invention the sum signal transmitted from the encoder may comprise a plurality of channels E, which may be a product of the M to E down mixing at the encoder 104. In these embodiments of the invention the bitstream unpacker 1001 may output E separate bitstreams, whereby each bit stream may be presented to an instance of the audio decoder 1005 for decoding. As a consequence of this operation a decoded sum signal comprising E decoded time domain signals may be generated. Each decoded time domain signal may then be passed to a filter bank in order to convert the signal to a signal comprising a plurality of sub bands. The sub bands from the E converted time domain signal may be passed to an up mixing block. The up mixing block may then take a group of E sub bands, each sub band corresponding to the same sub band index from each input channel, and then up mix each of these E sub bands into C sub bands each one being distributed to a sub band of a particular output channel. The up mixing block will typically repeat this process for all sub bands. The mechanics of the up mixing process may be implemented as an E by C matrix, where the numbers in the matrix determine the relative contribution of each input channel to each output channel. The each output channel from the up mixing block may then be subjected to spatial audio cues relevant to the particular channel.

The process of generating the multi channel output via the BCC synthesiser 1007 is shown as processing step 1106 in FIG. 11.

The multi channel output 1010 from the BCC synthesiser 1007 may then form the output audio signal 114 from the decoder 108.

It is to be understood in embodiments of the invention that the multichannel audio signal may be transformed into a plurality of sub band multichannel signals for the application of the spatial audio cue enhancement process, in which each sub band may comprise a granularity of at least one frequency coefficient.

It is to be further understood that in other embodiments of the invention the multichannel audio signal may be transformed into two or more sub band multichannel signals for the application of the spatial audio cue enhancement process, in which each sub band may comprise a plurality of frequency coefficients.

The embodiments of the invention described above describe the codec in terms of separate encoders 104 and decoders 108 apparatus in order to assist the understanding of the processes involved. However, it would be appreciated that the apparatus, structures and operations may be implemented as a single encoder-decoder apparatus/structure/operation. Furthermore in some embodiments of the invention the coder and decoder may share some/or all common elements.

Although the above examples describe embodiments of the invention operating within a codec within an electronic device 610, it would be appreciated that the invention as described below may be implemented as part of any variable rate/adaptive rate audio (or speech) codec. Thus, for example, embodiments of the invention may be implemented in an audio codec which may implement audio coding over fixed or wired communication paths.

Thus user equipment may comprise an audio codec such as those described in embodiments of the invention above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs) and processors based on multi-core processor architecture, as non-limiting examples.

Embodiments of the inventions may be practiced in various components such as integrated circuit modules. The design of integrated circuits is by and large a highly automated process: Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

estimating a value representing a direction of arrival associated with a first audio signal from at least a first channel and a second audio signal from at least a second channel of at least two channels of a multichannel audio signal;

determining a scaling factor based on the direction of arrival associated with the first audio signal and the second audio signal;

determining a reliability estimate for the value representing the direction of arrival associated with the first audio signal and the second audio signal;

applying the scaling factor, based on the reliability estimate, to a parameter associated with a difference in audio signal levels between the first audio signal and the second audio signal; and determining a value representing the coherence of the first audio signal and the second audio signal.

2. The method of claim 1 wherein estimating the value representing the direction of arrival associated with a first audio signal and a second audio signal comprises:

using a first model based on a direction of arrival of a virtual audio signal, wherein the virtual audio signal is associated with an audio signal derived from the combining of at least two audio signals emanating from at least two audio signal sources.

3. The method of claim 2, wherein the first model based on the direction of arrival of the virtual audio signal is based on a difference in audio signal levels between two audio signals.

4. The method of claim 2, wherein the first model based on the direction of travel of the virtual audio signal comprises a spherical model of the head.

5. The method of claim 1, wherein determining the reliability estimate for the value representing the direction of arrival associated with the first audio signal and the second audio signal comprises:

estimating at least one further value representing the direction of arrival associated with the first audio signal and the second audio signal, wherein estimating the at least one further value representing the direction of arrival associated with the first audio signal and the second audio signal further comprises using a second model based on the direction of arrival of a virtual audio signal, wherein the virtual audio signal is associated with an audio signal derived from the combining of at least two audio signals emanating from at least two audio signal sources; and determining whether the difference between the value representing the direction of arrival associated with the first audio signal and the second audio signal, and the at least one further value representing the direction of arrival associated with the first audio signal and the second audio signal lies within a predetermined error bound.

6. The method of claim 5, wherein the second model based on the direction of arrival of the virtual audio signal is based on a difference in a time of arrival between two audio signals.

7. The method of claim 5, wherein the second model based on the direction of travel of the virtual audio signal comprises a model based on the sine wave panning law.

8. The method of claim 1 wherein determining the scaling factor based on the direction of arrival associated with the first audio signal and the second audio signal comprises:

assigning the scaling factor a value from a first pre determined range of values of at least one pre determined range of values, wherein the first pre determined range of values is selected according to the value representing a direction of travel of a virtual audio signal associated with the first audio signal and the second audio signal.

9. The method of claim 1, wherein applying the scaling factor to the parameter associated with the difference in audio signal levels between the first audio signal and the second audio signal comprises:

multiplying the scaling factor with the parameter associated with the difference in audio signal levels between the first audio signal and the second audio signal.

10. The method of claim 1, wherein the multichannel audio signal is a frequency domain signal.

11. The method of claim 1, wherein the multichannel audio signal is partitioned into a plurality of sub bands, and the method for enhancing the multichannel audio signal is applied to at least one of the plurality of sub bands.

12. An apparatus comprising at least one processor and at least one memory including computer program code the at least one memory and the computer program code configured to, with the at least one processor, cause the apparatus at least to:

estimate a value representing a direction of arrival associated with a first audio signal from at least a first channel and a second audio signal from at least a second channel of at least two channels of a multichannel audio signal;

determine a scaling factor based on the direction of arrival associated with the first audio signal and the second audio signal;

determine a reliability estimate for the value representing the direction of arrival associated with the first audio signal and the second audio signal;

apply the scaling factor, based on the reliability estimate, to a parameter associated with a difference in audio signal levels between the first audio signal and the second audio signal; and determine a value representing the coherence of the first audio signal and the second audio signal.

13. The apparatus of claim 12, wherein the at least one memory and the computer program code configured, with the at least one processor, cause the apparatus at least to estimate the value representing the direction of arrival associated with a first audio signal and a second audio signal is further configured to cause the apparatus at least to:

use a first model based on a direction of arrival of a virtual audio signal, wherein the virtual audio signal is associated with an audio signal derived from the combining of at least two audio signals emanating from at least two audio signal sources.

14. The apparatus of claim 13, wherein the first model based on the direction of arrival of the virtual audio signal is based on a difference in audio signal levels between two audio signals.

15. The apparatus of claim 13, wherein the first model based on the direction of travel of the virtual audio signal comprises a spherical model of the head.

16. The apparatus of claim 12, wherein the at least one memory and the computer program code configured, with the at least one processor, cause the apparatus at least to determine the reliability estimate for the value representing the direction of arrival associated with the first audio signal and the second audio signal is further configured to cause the apparatus at least to:

estimate at least one further value representing the direction of arrival associated with the first audio signal and the second audio signal, wherein estimating the at least one further value representing the direction of arrival associated with the first audio signal and the second audio signal further comprises using a second model based on the direction of arrival of a virtual audio signal, wherein the virtual audio signal is associated with an audio signal derived from the combining of at least two audio signals emanating from at least two audio signal sources; and determine whether the difference between the value representing the direction of arrival associated with the first audio signal and the second audio signal, and the at least one further value representing the direction of arrival associated with the first audio signal and the second audio signal lies within a predetermined error bound.

17. The apparatus of claim 16, wherein the second model based on the direction of arrival of the virtual audio signal is based on a difference in a time of arrival between two audio signals.

18. The apparatus of claim 16, wherein the second model based on the direction of travel of the virtual audio signal comprises a model based on the sine wave panning law.

19. The apparatus of claim 12, wherein the at least one memory and the computer program code configured, with the at least one processor, cause the apparatus at least to determine the scaling factor based on the direction of arrival associated with the first audio signal and the second audio signal is further configured to cause the apparatus at least to:

assign the scaling factor a value from a first pre determined range of values of at least one pre determined range of values, wherein the first pre determined range of values is selected according to the value representing a direction of travel of a virtual audio signal associated with the first audio signal and the second audio signal.

20. The apparatus of claim 12, wherein the at least one memory and the computer program code configured, with the at least one processor, to cause the apparatus at least to:

multiply the scaling factor with the parameter associated with the difference in audio signal levels between the first audio signal and the second audio signal.

21. The apparatus of claim 12, wherein the multichannel audio signal is a frequency domain signal.

22. The apparatus of claim 12, wherein the multichannel audio signal is partitioned into a plurality of sub bands, and the apparatus is configured to enhance at least one of the plurality of sub bands of the multichannel audio signal.

* * * * *